United States Patent [19]

Bramfitt et al.

[11] 4,415,376

[45] Nov. 15, 1983

[54] FORMABLE HIGH STRENGTH LOW ALLOY STEEL SHEET

[75] Inventors: Bruce L. Bramfitt; Steven S. Hansen, both of Bethlehem; Donald L. Harper, Easton; Roger R. Pradhan, Nazareth, all of Pa.

[73] Assignee: Bethlehem Steel Corporation, Bethlehem, Pa.

[21] Appl. No.: 349,097

[22] Filed: Feb. 16, 1982

Related U.S. Application Data

[63] Continuation-in-part of Ser. No. 174,321, Aug. 1, 1980, abandoned.

[51] Int. Cl.[3] ..... C21D 8/02; C22C 38/12

[52] U.S. Cl. ..... 148/12 F; 75/123 J; 148/36

[58] Field of Search ..... 148/12 F, 36; 75/123 J

[56] References Cited

U.S. PATENT DOCUMENTS

| | | | |
|---|---|---|---|
| 3,673,007 | 6/1972 | Miyano et al. | 148/12.3 |
| 3,849,209 | 11/1974 | Ishizaki et al. | 148/12 F |
| 3,947,293 | 3/1976 | Takechi et al. | 148/12 F |
| 3,997,372 | 12/1976 | Matas et al. | 148/36 |
| 4,127,427 | 11/1978 | Hirano et al. | 148/12 C |
| 4,142,922 | 3/1979 | Abraham et al. | 148/36 |

FOREIGN PATENT DOCUMENTS

| | | | |
|---|---|---|---|
| 47-506 | 1/1972 | Japan | 148/12 F |
| 52-20322 | 2/1977 | Japan | 75/123 J |
| 52-28425 | 3/1977 | Japan | 148/12 F |
| 53-129117 | 11/1978 | Japan | 148/12 F |
| 54-58619 | 5/1979 | Japan | 148/12 F |

OTHER PUBLICATIONS

Pradhan, "Effect of Sulfur on Forming Properties of Hot Rolled HSLA Steel Sheet," Mechanical Working and Steel Processing XVII, The Iron & Steel Society of AIME, Warrendale, PA, 1979, pp. 1-18.

Grozier, "Production of Microalloyed Strip and Plate by Controlled Cooling," Microalloying '75, Wash., D.C., Oct., 1975, Session 2A, pp. 23-32.

Greday, "The Combined Effects of Microalloying with Cb and V," Microalloying '75, Wash., D.C., Oct., 1975, Session 1, pp. 145-158.

*Primary Examiner*—Peter K. Skiff

*Attorney, Agent, or Firm*—John I. Iverson; William B. Noll

[57] ABSTRACT

This invention is directed to a hot-rolled steel sheet having an essentially refined ferritic grain size, a balanced chemical composition comprising, by weight, 0.06 to 0.09% carbon, 1.0 to 1.6% manganese, 0.5% maximum silicon, 0.03 to 0.05% columbium, 0.06 to 0.12% vanadium, 0.010 to 0.025% nitrogen, 0.004% maximum sulfur, 0.02% maximum phosphorus, 0.02 to 0.08% aluminum, balance essentially iron, and characterized by 80 ksi minimum yield strength, improved transverse bendability, and improved sheared edge stretchability.

6 Claims, 4 Drawing Figures

FORMABLE HIGH STRENGTH LOW ALLOY STEEL SHEET

RELATED APPLICATION

This application is a continuation-in-part of abandoned U.S. Pat. Ser. No. 174,321, filed Aug. 1, 1980 and entitled "Formable High Strength Low Alloy Sheet Steel."

FIELD OF INVENTION

This invention relates to high strength low alloy (HSLA) steel sheet. More particularly, this invention relates to columbium (Cb) and vanadium (V) containing steel sheet or strip product having good mechanical properties, i.e. yield strength greater than 80 ksi (80,000 pounds per square inch), excellent transverse bendability and improved sheared edge stretchability.

BACKGROUND OF THE INVENTION

The past decade has seen the automotive industry striving to reduce vehicle weight without sacrificing overall structural integrity. As a result there has emerged a demand for relatively high strength-to-weight engineering materials, such as sheet or strip, produced from cost effective, high strength low alloy steels.

Well known in the art are HSLA steels, in the form of sheet or plate, having low carbon contents which attain high strength and toughness through the addition of Cb or V, or both, as well as additions of other microalloy strengthening elements such as Ti. The prior art is replete with disclosures teaching desirable weight percentage additions of Cb and V, singly or in various combinations, for increasing the yield strength of steel compositions. For example, U.S. Pat. No. 3,254,991 discloses Cb containing steels in plate or sheet, such steels having a yield strength of 100-175 ksi in the heat treated condition. This patent teaches that Cb is included for grain refinement and that V can be substituted for Cb in whole or in part. To obtain the same grain refinement effect when substituting V for Cb, the quantity of V added should be twice the quantity of Cb replaced. U.S. Pat. No. 3,472,707 discloses Cb and V containing structural steels that have a ferritic microstructure containing precipitated carbides and carbonitrides of Cb and/or V and contain less than 2% by volume pearlite. U.S. Pat. No. 3,897,279 discloses high strength, notch-tough, Al-killed plate steels containing Cb and V. U.S. Pat. No. 3,997,372 discloses Cb and V containing HSLA sheet steels having a yield strength above 80 ksi and indicates that Cb and V are not alternative, that is to say that Cb and V are not interchangeable and both must be present. British Pat. No. 1,123,114 discloses HSLA plate steels characterized by a fine grained ferritic microstructure containing precipitated carbide or carbonitrides of Cb and/or V.

Although the art reveals a number of patents directed to Cb and V containing high strength steel compositions, for the most part, the hot rolled products made from the HSLA steels disclosed by such patents suffer from anisotropic mechanical properties. The art does not teach Cb and V HSLA steel sheet having at least 80 ksi minimum yield strength in combination with isotropic bendability properties. Furthermore, there is no teaching of a steel sheet that attains 80 ksi minimum yield strength by controlling the Cb and V content in a specific relationship with the carbon (C) and nitrogen (N) content.

Anistropic properties in HSLA steels have been attributed in part to the sulfur content. In conventional steels the sulfur exists in the form of manganese sulfide (MnS) inclusions. At hot rolling temperatures for sheet and plate, these manganese sulfides are plastic and deform into elongated stringers in the rolling, or longitudinal, direction. The resulting shape and the distribution of sulfide stringers have a marked effect on the directional, or isotropic properties of most steel products. For example, the formability of sheet, and notch toughness of hot rolled plate, in the direction longitudinal to rolling is superior to that measured in the transverse direction.

U.S. Pat. Nos. 3,666,570 and Re. 28,790 disclose Cb or V containing HSLA sheet steels having improved formability. Zirconium or rare earth metals are added as a sulfide inclusion shape-control agent. During hot rolling these complex sulfides do not deform and thus a more isotropic steel product is produced. An alternative approach to improving the transverse proerties of steel is taught in U.S. Pat. No. 3,767,387 which discloses Cb containing high tensile strength steels having improved press shapability for making plates. The sulfur content of these steels is limited to 0.01 weight percent maximum. (Hereinafter, the amount of each element in a steel composition will be represented as a weight percent value.) A critical relationship between the total carbon and sulfur content and excellent press shapability is stated to exist such that the sum of % C plus 10(%S) should be less than 0.25. U.S. Pat. No. 4,142,922 discloses an HSLA sheet steel having yield strengths up to and in excess of 80 ksi, and containing low carbon and low manganese, very little silicon, and moderate proportions of Cb and V. The prescribed levels of C, Mn and Si afford rolled products that exhibit improved properties of toughness and formability in transverse as well as longitudinal directions without special additions of shape control agents or special processing.

S. Miyoshi et al, "Manufacture of High Strength Steel for Line Pipe in LD Converters—Manufacture of Low Sulfur Steel and REM Treated Steel," Revue De Metallurgie (April 1974), p. 395–405, disclose improving the properties of plate in a transverse direction, particularly with respect to improving the shelf energy of steel pipe. This article teaches reducing the sulfur content in control rolled steel plate for minimizing MnS inclusions elongated by hot rolling. A method is disclosed for producing extra low sulfur steel of less than 0.007 S. Miyoshi et al show the effect of the sulfur content on the transverse shelf energy of 14 mm (0.55 in.) steel plate. As the sulfur content is lowered, the shelf energy rises, particularly at a sulfur content of less than 0.010.

J. J. Bosley et al, "Steel Ladle Practices for Desulfurization and Sulfide Morphology Control at U.S. Steel," Proceedings, AIME Electric Furnace Conference, vol. 36, p. 28, 1978 mention arctic line pipe having improved transverse low temperature properties and 45–80 ksi minimum yield strength steels having good formability as two important developing applications of steels exhibiting isotropic properties. Bosley et al state that the problem of directionality in plate steel can be minimized by reducing the sulfur content in the steel product or by adding elements having greater affinity for sulfur than Mn, such as rare earth metals, to modify the plasticity of the sulfide inclusions remaining in the steel. Two methods for reducing the sulfur content and simultaneously controlling the shape of the sulfide inclusions are discussed.

There are therefore suggestions that the transverse properties of steel may be improved by reducing the sulfur content of the steel or by modifying the morphology of the sulfide inclusions. While both practices have been used in the platemaking art for a number of years, workers in the sheetmaking art have only made use of sulfide shape control and have ignored desulfurization. We believe that workers in the sheetmaking art have ignored the practices of the platemaking art for the following reasons. Workers in the platemaking art are primarily concerned about transverse toughness as determined by the Charpy test. Therefore, previous work on the desulfurization of plate steel and on the addition of sulfide shape control agents to plate steel was principally directed to improving the transverse toughness of the plate. The concerns with the mechanical properties of sheet and plate are not coextensive. That is, while bendability or formability are a mutual concern, sheared edge stretchability is of no concern in the platemaking art. Likewise, transverse toughness is of little or no concern to workers in the sheetmaking art. Therefore, no data were ever developed by workers in the sheetmaking art showing whether formability improvements could be gained by desulfurizing sheet steels. Consequently, there was no incentive to incorporate the desulfurization practices being used in the platemaking art for producing HSLA steel sheet.

Accordingly, an object of this invention is a HSLA steel sheet suitable for automotive applications which has an 80 ksi minimum yield strength that is attained by the interrelationship of particular amounts of Cb, V, C and N.

Another object of this invention is a Cb and V containing 80 ksi yield strength HSLA steel sheet possessing improved transverse bendability and improved sheared edge stretchability.

Yet another object of this invention is an 80 ksi minimum yield strength HSLA steel sheet containing Cb. and V as strengthening agents and having isotropic cold bending properties and improved sheared edge stretchability.

SUMMARY OF THE INVENTION

The above objects have been achieved by a steel sheet which has a yield strength of at least 80 ksi, improved transverse bendability and improved sheared edge stretchability and which consists essentially of the following in weight percent: 0.06–0.09 C, 1.0–1.6 Mn, 0.5 max. Si, 0.03–0.05 Cb, 0.06–0.12 V, 0.010–0.025 N, 0.004 max. S, 0.02 max. P and 0.02–0.08 Al and the balance Fe with residual impurities and incidental elements. Within the broader range above, there are the preferred limits of 0.03–0.04 Cb, 0.07–0.09 V and 0.015–0.025 N. The transverse bendability values of sheet of this invention are typically ½t or less and, in many instances, the values are Ot. Bendability is defined as d/t, where t is the sheet thickness and d is the measured internal diameter of the bend when the first crack develops on the outer bend radius.

Steels having compositions within the above ranges are prepared by essentially conventional means well known in the steelmaking art for producing low carbon, low alloy aluminum-killed steels in an electric or basic oxygen furnace. Additions of the several required elements are made in a manner appropriate for such elements. For example, if necessary, Mn may be added in the furnace or ladle as ferro-manganese. The microalloy additions of Cb and V may be achieved by adding appropriate material, such as ferro-alloys, to the melt in the ladle during tapping. A critical aspect of the invention is that the melt be desulfurized to 0.004 max. S, for example, by ladle desulfurization.

Ingots made from a steel melt having a composition within the above ranges are reduced to slab or the like for final reduction by hot rolling through a requisite number of passes at a predetermined finishing temperature. A very attractive feature of this invention is that no special or elaborate thermomechanical treatment is required to imbue the steel sheet with the desired properties of 80 ksi yield strength, improved transverse bendability and improved sheared edge stretchability. The thermomechanical treatment of a slab having a composition within the above ranges is that of a typical hot strip mill rolling schedule. For example, a 6–10 inch (152.4–254 mm) slab is heated to 2100°–2300° F. (1149°–1260° C.) for more than two hours and its thickness is reduced to 0.07–0.50 inch (1.8–12.7 mm), preferably 0.07–0.25 inch (1.8–6.4 mm), by rolling at temperatures above 1550° F. (844° C.), typically about 1650° F. (899° C.), followed by cooling at a rate of about 20°–70° F./sec. (11°–39° C./sec) by water sprays to a temperature less than 1200° F. (649° C.). The strip is coiled in a temperature range of about 950°–1200° F. (150°–649° C.), typically about 1150°–1200° F. (621°–649° C.), and cooled to room temperature over a 24–36 hour period.

DETAILED DESCRIPTION OF THE INVENTION

Figure 1:
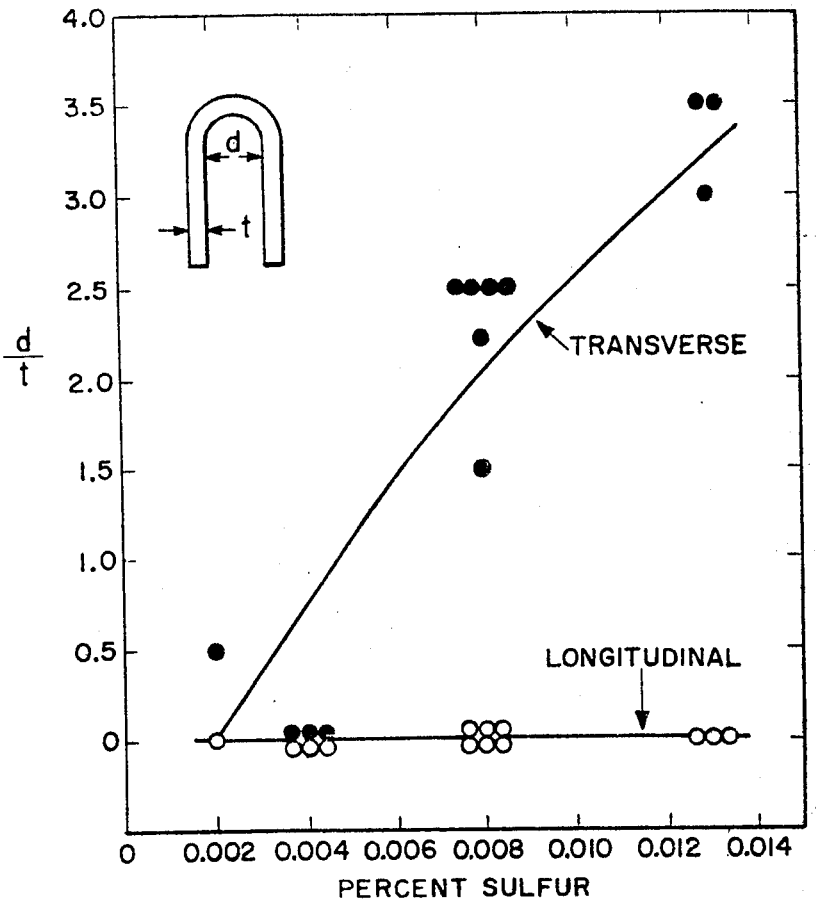
FIG. 1 graphically presents the bend formability of an 80 ksi Cb/V HSLA hot-rolled steel sheet as a function of sulfur content.

All phases of steel production, including steelmaking, casting practice, slab reheating and hot rolling practice, were considered in attempting to design Cb and V containing HSLA sheet steels having an 80 ksi minimum yield strength. The composition of such Cb and V containing HSLA sheet steels consists essentially of the following in weight percent: 0.06–0.09 C, 1.0–1.6 Mn, 0.5 max. Si, 0.03–0.05 Cb, 0.06–0.12 V, 0.010–0.025 N, 0.006 max. S, 0.02 max. P and 0.02–0.08 Al, the balance Fe with residual impurities and incidental elements. However, as will be demonstrated later, particularly with respect to FIGS. 2 and 3, it was discovered that a critical correlation exists between thesheared edge stretchability, and the sulfur and carbon contents. Thus, within the design limits above, the carbon should preferably be 0.06 to 0.09%, by weight. The sulfur content, on the other hand, should be a maximum of 0.004%, by weight. Finally, a preferred range for nitrogen is 0.015 to 0.025%, by weight. While the 80 ksi yield strength was attained within the design limits above, surprisingly the transverse bendability and sheared edge stretchability of strip rolled from steel within the precise limits for carbon and sulfur was far superior to the improvement which was anticipated for such HSLA steel sheet.

A key aspect of the invention is the selection of alloying elements that can be dissolved in the steel during heating in the slab reheating furnace prior to rolling on the hot strip mill. The C, N, Cb and V levels are based partly on the solubility data for Cb and V carbonitride (C,N) compounds in austenite. For example, at 2300° F., in a 0.10 C, 0.01 N steel about 0.08 Cb can dissolve given sufficient time at that temperature. On the other hand, V is about two orders of magnitude more soluble and about 1.0 V can be taken into solution in the same steel at 2300° F. Since only the amount of Cb and V that can be dissolved during reheating is effective in contributing to subsequent strengthening via grain refinement and precipitation hardening, the amount of soluble Cb and V is an important consideration. The steel sheet of this invention comprises an alloy that has been designed to assure that all the Cb and V can be dissolved at 2100° F. in order to provide a safety margin in case the slab is not completely soaked out at temperatures up to 2300° F. for a sufficient time, generally at least one hour.

This design feature of the sheet steel of this invention is quite significant if for no other reason than the savings in energy costs in soaking the slabs prior to processing the slabs into sheet. That is, the sheet steels having the Cb and V balanced as above can be processed to their full strength potential when soaked at temperatures between 2100° to 2300° F. (1149°–1260° C.), temperatures below that which are conventially applied to HSLA steels. This feature will be discussed in more detail hereinafter.

Another key aspect of the steel sheet invention is an alloying system that exploits the benefits of hot strip mill processing. The strengthening mechanisms of grain refinement, solid solution and precipitation hardening were used in predetermined combination. Each of the alloying elements was selected to play a distinct role in the strengthening process.

Manganese in a range of 1.0–1.6, preferably 1.2–1.4, and silicon up to a 0.5 max. level, preferably in a range of 0.25–0.4, are added to provide a degree of solid solution strengthening. Manganese also contributes to a fine ferrite grain size by controlling the temperature range over which the austenite to ferrite transformation occurs.

Nitrogen in a range of 0.010–0.025 and carbon in a range of 0.06–0.09 are added to combine with Cb and V to form carbonitride (C,N) precipitates. Thus, there is a critical relationship among C, N, Cb and V as discussed hereinafter.

Columbium and vanadium are the most important elements in that they are the key to the grain refinement and precipitation strengthening of the steel strip. Accordingly, the steel sheet should contain 0.03–0.05 Cb and 0.06–0.12 V. In the preferred embodiment, Cb at the 0.03–0.04 level along with the carbon act to retard austenite recrystallization between passes in the finishing strands. This retardation results in a pancaked austenite morphology after finish rolling, and leads to a refined ferritic grain size on subsequent transformation. The levels of Cb and C, 0.03–0.05 and 0.06–0.09 respectively, are sufficient to ensure Cb (C,N) precipitation in the austenite and hence to prevent austenite recrystallization over most of the temperature range encountered during the finish rolling, e.g. 1600°–1800° F. (871°–982° C.). Thus, with respect to the preferred embodiment, the C and Cb amounts are fixed at 0.06–0.09 C and 0.03–0.04 Cb to prevent austenite recrystallization and, consequently, increase strength via ferritic grain refinement. The Cb is added primarily for this purpose, although some precipitation hardening may result from Cb (C,N) precipitation in the austenite.

Conversely, in specifying the V addition between 0.06–0.12, advantage is taken of the much higher solubility of V in austenite and hence the negligible precipitation of vanadium nitride (VN) during finish rolling. At these levels the VN does not influence austenite recrystallization, but is retained in solution during rolling and precipitates in the ferrite during run-out table and coil cooling. Such precipitates are very fine (less than 5 nm) and provide a significant precipitation hardening increment to the ferrite, and in conjunction with the ferrite grain refinement produced by Cb and solid solution hardening of Mn and Si, allow achievement of an 80 ksi yield strength level. Since the stoichiometric ratio of V:N in VN is about 4:1, advantageously the ratio of V:N in alloy compositions composing the steel sheets of this invention should also be about 4:1. Thus the effectiveness of the VN precipitate dispersion can be maximized since all the V is tied up as a precipitate. The combination of Cb for ferrite grain refinement and V for ferrite precipitation is believed novel with respect to producing steel strip on a hot strip mill.

Another key aspect of the invention is the steel-making practice. An integral part of this steelmaking practice involves desulfurization to 0.004 max. S in the ladle, preferably via a calcium/silicon injection treatment. The unexpected degree of bendability of the steel sheet or strip of this invention is due to the removal of S to 0.004 max. which in a non-treated steel would be in the form of manganese sulfides. During hot rolling of non-treated steel, these sulfides become elongated in the rolling direction and contribute to poor transverse bendability and poor sheared edge stretchability.

R. R. Pradhan, "Effect of Sulfur on Forming Properties of Hot Rolled HSLA Sheet Steel," Proceedings of the 21st Mechanical Working and Steel Processing Conference, Oct. 25, 1979, Cleveland, Ohio, has shown that in an 80 ksi HSLA steel, the anisotropy in bend properties can be practically eliminated if S in the form of manganese sulfides is reduced to or below about 0.004, and transverse bendability is greatly improved at 0.004 max. S levels. Simultaneously, this removal of stringer-type inclusions contributes to a considerable improvement in sheared edge stretchability.

Figure 2:
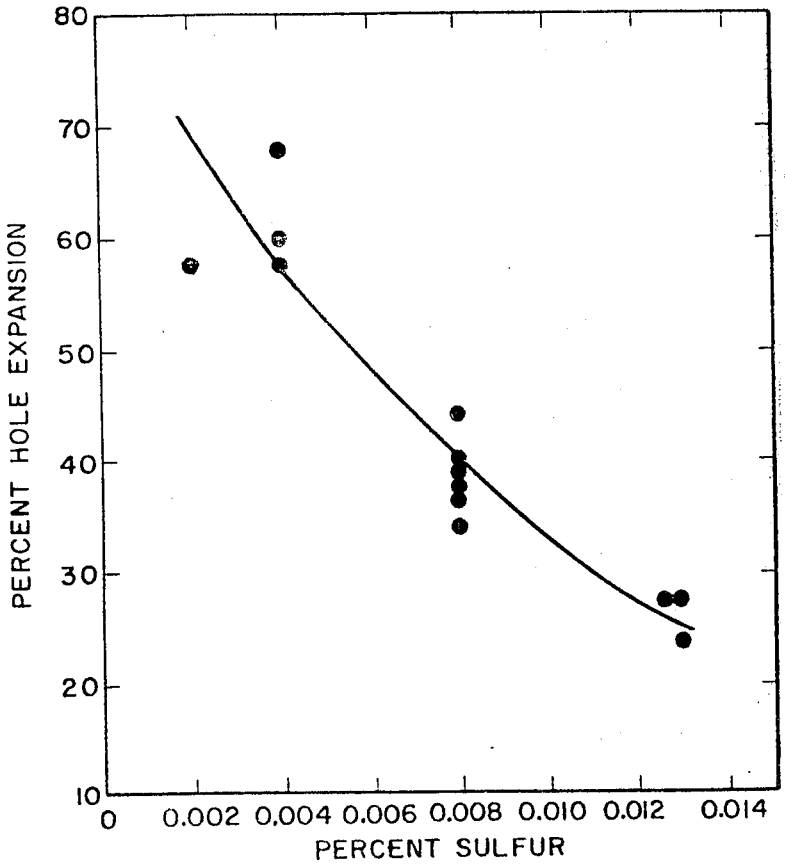
FIG. 2 graphically presents the hole enlargement of an 80 ksi Cb/V HSLA hot-rolled steel sheet as a function of sulfur content.
Figure 3:
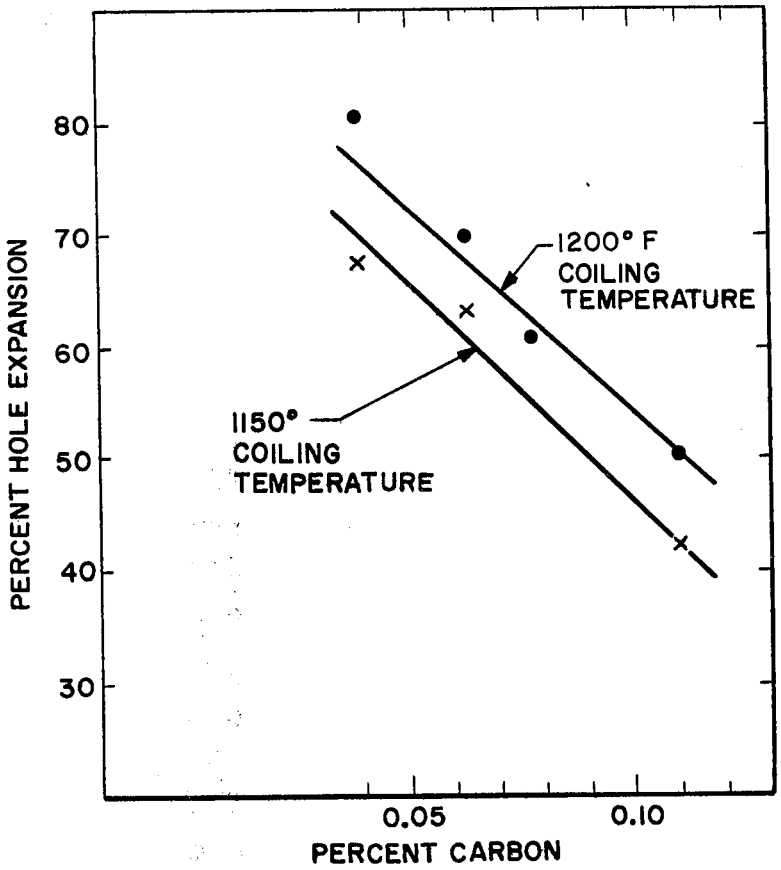
FIG. 3 graphically presents the hole enlargement of an 80 ksi Cb/V HSLA hot-rolled steel sheet as a function of carbon content.

While Pradhan's data were developed using laboratory melted and processed V-microalloyed steel sheet, similar trends result for the Cb- and V-microalloyed steel sheet of this invention as shown in FIGS. 1 and 2 and in TABLE II, hereinafter.

In the calcium/silicon treatment the calcium reacts with the sulfur in the melt to form calcium bearing sulfides which float out of the liquid steel and into the slag cover. Calcium aluminum oxides may also form. The calcium/silicon injection eliminates the formation of deformable manganese sulfides and, in addition, ensures that any remaining sulfur will be present as calcium sulfides or as calcium-manganese sulfides. These sulfides, along with the complex aluminates which are also present, do not elongate during rolling. These small, spherical aluminates and sulfides do not significantly impair the transverse bendability. The overall reduction in sulfur content along with this change in sulfide morphology in the as-rolled sheet are also the factors responsible for the improved sheared edge stretchability of this Cb and V HSLA steel sheet.

Prior to the paper by co-inventor R. R. Pradhan little data was available on the forming modes of steel sheet relative to the S content of the sheel steel composition.

To illustrate the critical compositional balance required to obtain the desirable properties of high strength, improved transverse bendability and improved sheared edge stretchability nine separate heats of varying chemistry were processed into sheet form and subjected to the following tests:

Tensile Test:

Tensile tests were performed on standard sheet tensile specimens 8.0 in (203 mm) in overall length and gage dimensions of 2.5 in (63.5 mm) long×0.5 in (12.7 mm) wide. The tests were conducted at a strain rate of 0.5/min.

Bend Test:

Table I shows the major alloying elements of five heats (S varied between 0.002 to 0.013%) which were thermomechanically processed as described above into strip and coiled. Examples 4 and 5 have compositions within the scope of this invention.

TABLE I

| | C | Mn | Si | Cb | V | S |
|---|---|---|---|---|---|---|
| Example 1 | .10 | 1.25 | .40 | .037 | .07 | .008 |
| Example 2 | .06 | 1.29 | .26 | .038 | .12 | .008 |
| Example 3 | .07 | 1.22 | .04 | .033 | .11 | .013 |
| Example 4 | .09 | 1.27 | .32 | .034 | .07 | .004 |
| Example 5 | .07 | 1.33 | .33 | .049 | .09 | .002 |

Table II presents the data obtained by performing the above-described tests on samples of the coiled strip of Examples 1–5. In FIGS. 1 and 2 the bend data and the hole enlargement data are also plotted against the percent sulfur, respectively.

TABLE II

| Final Gage (inch) | Example 1 | | | Example 2 | | | Example 3 | | | Example 4 | | | Example 5 | | |
|---|---|---|---|---|---|---|---|---|---|---|---|---|---|---|---|
| Sulfur Content | 0.110 | | | 0.109 | | | 0.109 | | | 0.105 | | | 0.107 | | |
| | 0.008 | | | 0.008 | | | 0.013 | | | 0.004 | | | 0.002 | | |
| Mechanical Property (F,M.B)* | F | M | B | F | M | B | F | M | B | F | M | B | F | M | B |
| Yield Strength (ksi) | 86.4 | 84.1 | 85.4 | 92.0 | 90.5 | 90.7 | 88.5 | 90.0 | 88.7 | 81.9 | 84.2 | 83.0 | | 84.5 | |
| Ultimate Tensile Strength (ksi) | 102.2 | 99.2 | 103.7 | 106.8 | 105.5 | 104.2 | 101.7 | 103.7 | 102.4 | 97.3 | 100.4 | 99.1 | | 98.0 | |
| Tensile Elongation (%) | 22.0 | 22.0 | 21.0 | 20.5 | 20.0 | 20.0 | 22.0 | 21.5 | 20.0 | 21.5 | 22.5 | 21.5 | | 18.2 | |
| Longitudinal Bendability (F.M.B.) | Ot | Ot | Ot | Ot | Ot | Ot | Ot | Ot | Ot | Ot | Ot | Ot | | Ot | |
| Transverse Bendability (F.M.B.) | 2-½t | 2-½t | 2-½t | 2-½t | 2-½t | 1-½t | 3t | 3-½t | 3½t | Ot | Ot | Ot | | ½t | |
| Hole Enlargement (F,M,B) | 40% | 38% | 37% | 39% | 44% | 35% | 28% | 24% | 28% | 68% | 60% | 58% | | 58% | |

*F,M,B = Front, Middle, Back (Coil Positions)

The bend test consisted of prebending a 60 in (length)×1.5 in (width) (152.4×38.1 mm) sample through a 180° angle over a punch of 0.5 in (12.7 mm) radius. The sample was then gradually squeezed between the platens of a hydraulic testing machine at a speed of 0.5 in (12.7 mm) per minute to decrease the internal diameter of the bend. The test was stopped when the first crack to develop progressed through half the sheet thickness, and the internal diameter d was measured. Bendability was defined as d/t, where t is the thickness of the sheet. Samples were tested so that only one burr was oriented toward the tensile side of the bend. Tests were conducted on samples located in both longitudinal and transverse orientations with respect to the rolling direction.

Hole Enlargement Test:

This test is an effective method for assessing the performance of a steel sheet during a forming or flanging operation that involves significant amounts of edge extension, or sheared edge stretchability. The test, performed in a hydraulic press, consisted of enlarging a 0.5 in (12.7 mm) diameter punched hole, located in the center of a 5 in (127 mm) square blank, with a conical ram having a 20° apex angle and advancing at 2 in (50.8 mm) per minute. The edge of the punched hole characterized by a shear burr was oriented towards the ram. The test was stopped after the development of the first through-thickness crack. The percent hole enlargement was defined as $(D_F-D_I)\times 100/D_I$, where $D_I$ is the initial hole diameter and $D_F$ is the internal diameter of the enlarged hole.

Examples 1, 2 and 3 have their C, Mn, Si, Cb and V content substantially within the ranges of the chemistry composition disclosed for steel sheet of this invention and, accordingly, exhibit an 80 ksi minimum yield strength. However, with a sulfur content above about 0.004 these Examples have longitudinal bendability values of 0t, but transverse bendability values from 1½t to 3½t and hole enlargement values from 24% to 44%. In contrast, Examples 4 and 5 with sulfur contents of 0.004 to 0.002, respectively, surprisingly have excellent transverse bendability values of ½t or less, comparable to the longitudinal properties. That is, the bend anistropy is practically eliminated. The hole enlargement values range from 58 to 68% and demonstrate the improved sheared edge stretchability achieved via desulfurization. The marked benefits of desulfurization on transverse bendability and sheared edge stretchability are also clearly shown in FIGS. 1 and 2.

Table III shows the major alloying elements of four heats (C varied between 0.039 to 0.11%) which were processed in the laboratory by a procedure which simulates commercial hot-rolling with a simulated finishing temperature of 1650° F. (899° C.) and a simulated sheet coiling temperature of 1150° F. (621° C.) or 1200° F. (649° C.). Examples 7 and 8 have compositions within the scope of this invention.

TABLE III

| | C | Mn | Si | Cb | V | S |
|---|---|---|---|---|---|---|
| Example 6 | .039 | 1.22 | .062 | .037 | .13 | .004 |
| Example 7 | .063 | 1.15 | .016 | .039 | .10 | .004 |
| Example 8 | .077 | 1.14 | .091 | .040 | .092 | .004 |

TABLE III-continued

| | C | Mn | Si | Cb | V | S |
|---|---|---|---|---|---|---|
| Example 9 | .11 | 1.23 | .055 | .035 | .12 | .004 |

Table IV presents the data obtained in the mechanical testing and microstructure analysis of the coiled strip of Examples 6–9.

TABLE IV

| Final Gage (inch) | Example 6 | | Example 7 | | Example 8 | | Example 9 | |
|---|---|---|---|---|---|---|---|---|
| Carbon Content | 0.120 | | 0.122 | | 0.0130 | | 0.120 | |
| | 0.039 | | 0.063 | | 0.077 | | 0.11 | |
| Coiling Temperature (°F.) | 1150° | 1200° | 1150° | 1200° | 1150° | 1200° | 1150° | 1200° |
| Yield Strength (ksi) | 81.1 | 84.9 | 80.0 | 82.6 | | 81.7 | 87.3 | 88.2 |
| Ultimate Tensile Strength (ksi) | 89.6 | 92.1 | 89.4 | 91.0 | | 91.5 | 99.0 | 99.0 |
| Hole Enlargement (%) | 81.0 | 67.5 | 70.0 | 63.5 | | 61.0 | 42.5 | 50.2 |
| Microstructure, F = ferrite | | | | | | | | |
| P = pearlite | F | F | F | F | | F | F | F |
| B = bainite | P(1.4%) | C | P(2.7%) | C | | C | P | C |
| C = carbides | | | | | | B(4.8%) | B(30%) | B(5.8%) |

Examples 6 to 9 were processed by a simulated conventional hot-mill practice, but used the different coiling temperatures of 1150° F. (621° C.) and 1200° F. (649° C.). Thus, FIG. 3, which presents the data from Table IV, illustrates the further variable of coiling temperature along with the relationship between carbon content and hole enlargement. It will be noted that there is an inverse relationship between carbon content and hole enlargement. That is, as the carbon increases, hole enlargement significantly drops.

As is well known in the ferrous metallurgical art, particularly in the hot-rolling of steel strip and sheet, all of the slab to strip reduction occurs in the austenite region, i.e. finish rolling above about 1550° F. (843° C.), followed by rapid cooling of the strip on a run-out table and coiling. Depending on steel chemistry, the rapidity and extent of cooling on the run-out table can result in the formation of transformation products, such as bainite. The presence of such a transformation product can adversely affect the ductility and other properties related to ductility, such as hole enlargement. In Example 9, the steel strip having a carbon content of 0.11%, by weight, the microstructure of such strip revealed the presence of bainite. In the more severely cooled strip, i.e. the strip cooled to 1150° F. (621° C.), hole enlargement dropped to 42.5%, compared to the companion strip cooled to and coiled at 1200° F. which had a hole enlargement of 50.2%. Additionally, the percent of bainite was considerably higher in the former strip, namely, 30% to 5.8%. Therefore to maintain the improved sheared edge stretchability in these steels, the carbon content must be maintained below 0.09%.

As noted previously one key aspect of the invention is the ability of the Cb-V balanced steel of this invention to achieve its full strength potential of 80 ksi minimum yield strength through soaking at temperatures below 2300° F. prior to hot-strip mill processing. That is, the presence of the controlled amounts of Cb and V in the steels of this invention are fully effective in contributing to subsequent strengthening via grain refinement and precipitation hardening when soaked in slab form at temperatures in the range of about 2100° to 2250° F. (1149°–1232° C.). In contrast to this, other types of HSLA steels essentially relying on a single elemental Cb addition for strengthening require soaking temperatures of at least 2300° F. (1260° C.) to achieve a strength level in excess of 80 ksi yield strength. To demonstrate this key aspect of the present invention further examples of Cb-V and Cb steels were prepared and processed in the laboratory by a procedure which simulates commercial hot-rolling. The only processing variable was the soaking temperature prior to hot strip processing. The soak temperatures were varied between 2100° and 2300° F. (1149°–1260° C.), while the simulated finishing temperature was 1650° F. (899° C.) and the simulated coiling temperature was 1150° F. (621° C.) for a final sheet thickness of about $\frac{1}{8}''$ or between 0.120–0.130 inches.

Table V shows the major alloying elements of four heats processed as above, except for the specific soaking temperature noted in Table VI.

TABLE V

| | C | Mn | Si | Cb | V |
|---|---|---|---|---|---|
| Example 10 | 0.075 | 0.92 | 0.053 | 0.11 | 0.005 |
| Example 11 | 0.080 | 1.20 | 0.27 | 0.45 | 0.12 |
| Example 12 | 0.041 | 1.12 | 0.12 | 0.13 | 0.002 |
| Example 13 | 0.081 | 1.13 | 0.090 | 0.041 | 0.091 |

Table VI presents the strength data obtained in the testing of the processed strips of Examples 10–13.

TABLE VI

| | Soak Temp (°F.) | YS (ksi) | TS (ksi) |
|---|---|---|---|
| Example 10 | 2300 | 80.0 | 87.3 |
| | 2100 | 64.6 | 72.5 |
| Example 11 | 2300 | 84.6 | 94.3 |
| | 2100 | 80.0 | 92.3 |
| Example 12 | 2300 | 80.3 | 89.5 |
| | 2200 | 79.9 | 85.5 |
| | 2100 | 65.3 | 73.3 |
| Example 13 | 2300 | 85.6 | 96.6 |
| | 2200 | 83.2 | 92.3 |
| | 2100 | 76.5 | 87.5 |

Figure 4:
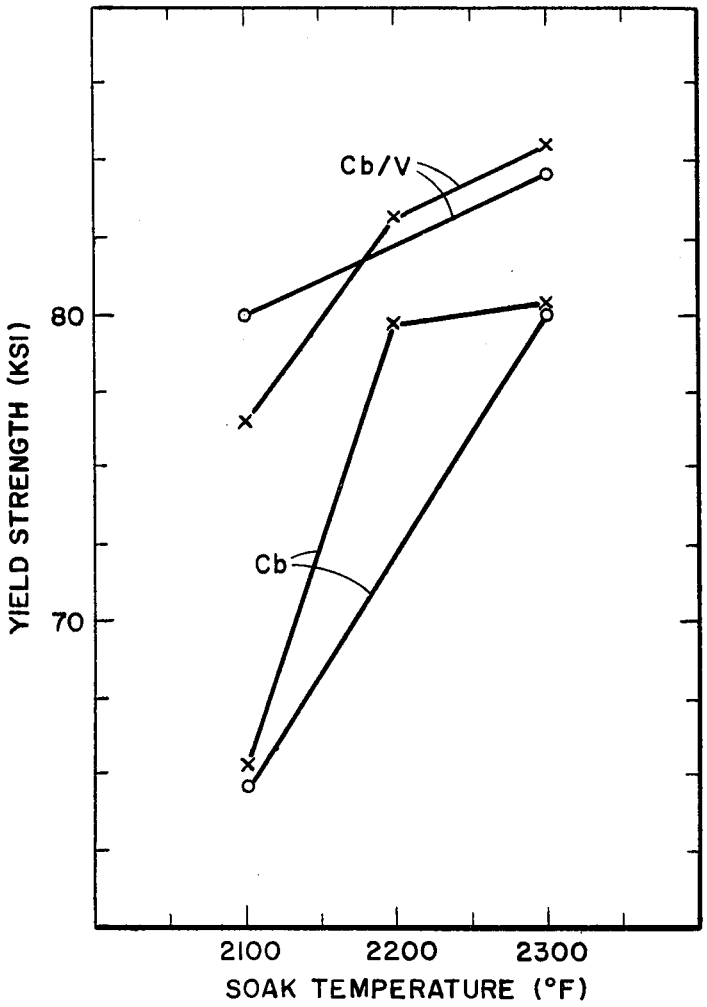
FIG. 4 graphically presents data on yield strength of Cb/V and Cb HSLA hot-rolled steel sheets as a function of soak temperature.

The yield strength for examples 10–13 is graphically presented in FIG. 4 as a function of soak temperature. The data clearly shows the desirable benefits in strength to be gained from the use of controlled amounts of Cb and V rather than by the use of the single element Cb for strengthening.

Thus, from the data presented herein, and to insure the production of a hot-rolled steel strip having an essentially refined ferritic grain size with the following mechanical properties:

(a) yield strength of at least 80 ksi, (b) transverse bendability of 1T or less, and (c) improved sheared edge stretchability, as measured by hole expansion of at least 58%, it is critical to balance the chemistry of such steel strip within the following ranges, by weight percent:

C—0.06 to 0.09

Mn—1.0 to 1.6
Si—0.5 max.
Cb—0.03 to 0.05
V—0.06 to 0.12
N—0.010 to 0.025
S—0.004 max
P—0.02 max.
Al—0.02 to 0.08, balance iron with residual impurities and incidental elements.

Further, it is possible to achieve such mechanical properties using low slab heating temperatures, on the order of 2100° to 2250° F. (1149°–1232° C.), followed by conventional hot-strip mill processing.

We claim:

1. A hot-rolled high strength steel sheet having an essentially refined ferritic grain size and a balanced chemical composition in which the elements thereof contributing to the strength of the steel through grain refinement and precipitation hardening are limited in quantity to that which will go completely into solution at a temperature above 2100° F., said chemistry consisting essentially of, by weight, 0.06 to 0.09% carbon, 1.0 to 1.6% manganese, 0.5% maximum silicon, 0.03 to 0.05 columbium, 0.07 to 0.09% vanadium, 0.010 to 0.025% nitrogen, 0.004% maximum sulfur, 0.02% maximum phosphorus, 0.02 to 0.08% aluminum, the balance iron with residual impurities and incidental elements, where said steel sheet is characterized by the mechanical properties of a yield strength of at least 80 ksi, a transverse bendability of 1T or less, and improved sheared edge stretchability as measured by hole expansion of at least 58%, and by a microstructure comprising fine grained ferrite containing VN precipitates of less than 5 nm.

2. The steel sheet according to claim 1 wherein the columbium and vanadium are said elements contributing to the strength of the steel and columbium is present in the range of 0.03 to 0.04%.

3. The steel sheet according to claim 2 wherein manganese is present in an amount between 1.2 and 1.4%, silicon is present in an amount between 0.25 and 0.40%, nitrogen is present in an amount of at least 0.015%, and aluminum is present in an amount between 0.04 and 0.06%.

4. A method of producing a high strength, hot-rolled steel sheet having a thickness in a range between about 0.07 to 0.25 inches, comprising the steps of (1) preparing a steel whose chemistry is balanced within the following limits, by weight, 0.06 to 0.09% carbon, 1.0 to 1.6% manganese, 0.5% maximum silicon, 0.03 to 0.05% columbium, 0.07 to 0.09% vanadium, 0.010 to to 0.025% nitrogen, 0.004% maximum sulfur, 0.02% maximum phosphorus, 0.02 to 0.08% aluminum, the balance iron with residual impurities and incidental elements, (2) forming said steel into slab form having a thickness in a range between about 6 to 10 inches, (3) soaking said slab at a temperature between about 2100° to 2250° F., (4) reducing the thickness of said slab to final sheet thickness at a temperature above about 1550° F., (5) cooling the reduced sheet to a temperature between about 950° to 1200° F. and forming said sheet into a coil, whereby to produce a steel sheet characterized by the mechanical properties of a yield strength of at least 80 ksi, a transverse bendability of 1T or less, and improved sheared edge stretchability as measured by hole expansion of at least 58%, and by a microstructure comprising fine grained ferrite containing VN precipitates of less than 5 nm.

5. The method according to claim 4 wherein columbium is present in the range of 0.03 to 0.04%.

6. The method according to claim 5 wherein manganese is present in an amount between 1.2 and 1.4% silicon is present in an amount between 0.25 and 0.40%, nitrogen is present in an amount of at least 0.015%, and aluminum is present in an amount between 0.04 and 0.06%.

* * * * *